US006349184B2

(12) United States Patent
Otomo

(10) Patent No.: US 6,349,184 B2
(45) Date of Patent: Feb. 19, 2002

(54) PROCESS CARTRIDGE WITH TONER AMOUNT DETECTOR HAVING DIFFERENT PATTERNS ACCORDING TO FILL AMOUNT

(75) Inventor: Yasunao Otomo, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/749,931

(22) Filed: Dec. 29, 2000

(30) Foreign Application Priority Data

Jan. 7, 2000 (JP) ..... 2000-001394

(51) Int. Cl.[7] ..... G03G 15/08
(52) U.S. Cl. ..... 399/27; 399/110
(58) Field of Search ..... 399/27, 28, 30, 399/110, 111; 73/304 C

(56) References Cited

U.S. PATENT DOCUMENTS 5,987,269 A * 11/1999 Allen et al. ..... 399/27
6,253,036 B1 * 6/2001 Karakama et al. ..... 399/27

FOREIGN PATENT DOCUMENTS

| | | |
|---|---|---|
| EP | 0992862 A2 | 4/2000 |
| EP | 0992866 A2 | 4/2000 |
| JP | 2000-122397 | 4/2000 |
| JP | 2000-122398 | 4/2000 |

* cited by examiner

*Primary Examiner*—Joan Pendegrass
(74) *Attorney, Agent, or Firm*—Fitzpatrick, Cella, Harper & Scinto

(57) ABSTRACT

A process cartridge detachably mountable on an electrophotographic image forming apparatus includes (a) an electrophotographic photosensitive member, (b) a developing device having a developer container containing therein a developer for developing an electrostatic latent image formed on the electrophotographic photosensitive member, and (c) a planar developer amount measuring device having a pair of electrodes arranged at a predetermined interval in the developer container, the pair of electrodes of the planar developer amount measuring device being constructed in different patterns in conformity with the initial fill developer amount in the developer container.

6 Claims, 10 Drawing Sheets

PROCESS CARTRIDGE WITH TONER AMOUNT DETECTOR HAVING DIFFERENT PATTERNS ACCORDING TO FILL AMOUNT

BACKGROUND OF THE INVENTION

1. Field of the Invention

This invention relates to an electrophotographic image forming apparatus for forming an electrostatic latent image on an electrophotographic photosensitive member by the electrophotographic method, and visualizing this electrostatic latent image by a developer contained in the developer container of a developing device, and particularly to an electrophotographic image forming apparatus having a developer remaining amount detecting device for detecting the remaining amount of developer contained in a developer container, and further to a process cartridge.

Here, the term "electrophotographic image forming apparatus" covers, for example, an electrophotographic copier, an electrophotographic printer (such as an LED printer or a laser beam printer), an electrophotographic facsimile apparatus and an electrophotographic word processor.

Also, the term "process cartridge" refers to at least one of charging means, developing means and cleaning means and an electrophotographic photosensitive member integrally made into a cartridge that is detachably mountable to the main body of an electrophotographic image forming apparatus, or at least developing means and an electrophotographic photosensitive member integrally made into a cartridge that is detachably mountable to the main body of an electrophotographic image forming apparatus.

2. Related Background Art

An electrophotographic image forming apparatus, such as a laser beam printer, applies a laser beam, corresponding to image information, to an electrophotographic photosensitive member to thereby form a latent image thereon, supplies a developer (toner) as a recording agent to this latent image by developing means to thereby visualize the latent image as a toner image, and further transfers this toner image from the electrophotographic photosensitive member to a recording sheet, which is a recording medium, to thereby form an image.

A toner containing portion, which is a developer container containing the toner therein, is connected to the developing means, and the toner in the toner containing portion is consumed by the image being formed. The toner containing portion, the developing means, the electrophotographic photosensitive member, etc., are often integrally made into a process cartridge, and when the toner is depleted, a user can again form an image by exchanging the process cartridge.

There is an apparatus provided with a construction for outputting an indication to the user so as to prepare the next process cartridge before the toner in the process cartridge is depleted and the quality of the image is reduced. Such an apparatus measures the amount of toner in the toner containing portion of the process cartridge.

A plane antenna is conceived as an example of means for measuring the amount of toner, i.e., developer amount measuring means. The plane antenna comprises a pair of electrodes juxtaposed at a predetermined interval on a substrate, and it is conceived to dispose it in the toner containing portion of the process cartridge along a direction in which the amount of toner changes.

When the toner in the toner containing portion contacts with this plane antenna and the amount of toner is great and the area of contact thereof with the plane antenna is large, the capacitance between the electrodes of the plane antenna is high, and when the amount of toner becomes small and the area of contact thereof with the plane antenna becomes small, the capacitance between the electrodes becomes low. Accordingly, by measuring the capacitance of the plane antenna, it is possible to successively know the amount of toner in the toner containing portion.

Now, as regards the process cartridge, there are sometimes prepared process cartridges mountable on the main body of the same apparatus but differing in the initial fill amount of toner so that a user can select the appropriate cartridge. They include, for example, a 6K cartridge capable of forming standard images on 6,000 sheets, and a 10K cartridge capable of forming standard images on 10,000 sheets.

However, in a case where as a method of indicating the amount of toner, a percentage of the amount of toner at a maximum is indicated as 00%, if the same cartridges differ in the maximum amount of toner they can hold, i.e., the initial fill amount of toner at the start of use, from each other, the area of contact of the toner with the plane antenna will differ. Therefore, a plane antenna of the same construction will become incapable of effecting accurate indication. In the above-mentioned example, if a plane antenna by which the amount of toner at a maximum is indicated as 100% in a 10K cartridge is used for the 6K cartridge, the capacitance of the plane antenna in the 10K cartridge is 60 pF for the maximum amount of toner, as shown in the graph of FIG. 9 of the accompanying drawings. In contrast, in the 6K cartridge, the capacitance is 40 pF. Thus, as shown in the graph of FIG. 10 of the accompanying drawings, in the 6K cartridge, the maximum amount of toner is indicated as 60%.

So, it is conceived to make the design such that even for process cartridges identical in construction with each other but differing in the maximum amount of toner from each other, the amount of toner in the process cartridge can be successively indicated accurately without means for discriminating the difference in the initial fill amount between the cartridges being provided on the main body of the apparatus.

SUMMARY OF THE INVENTION

It is an object of the present invention to provide a process cartridge and an electrophotographic image forming apparatus in which even for process cartridges identical in construction with each other but differing from each other in the maximum amount of developer, the amount of developer in the process cartridge can be successively indicated accurately.

It is another object of the present invention to provide a process cartridge in which the pair of electrodes of planar developer amount measuring means are constructed in different patterns in conformity with the initial fill developer amount in a developer container, and an electrophotographic image forming apparatus on which such process cartridge is detachably mountable.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

A process cartridge and an electrophotographic image forming apparatus according to the present invention will hereinafter be described in greater detail with reference to the drawings.

Embodiment 1

A first embodiment of the present invention will first be described.

Figure 1:
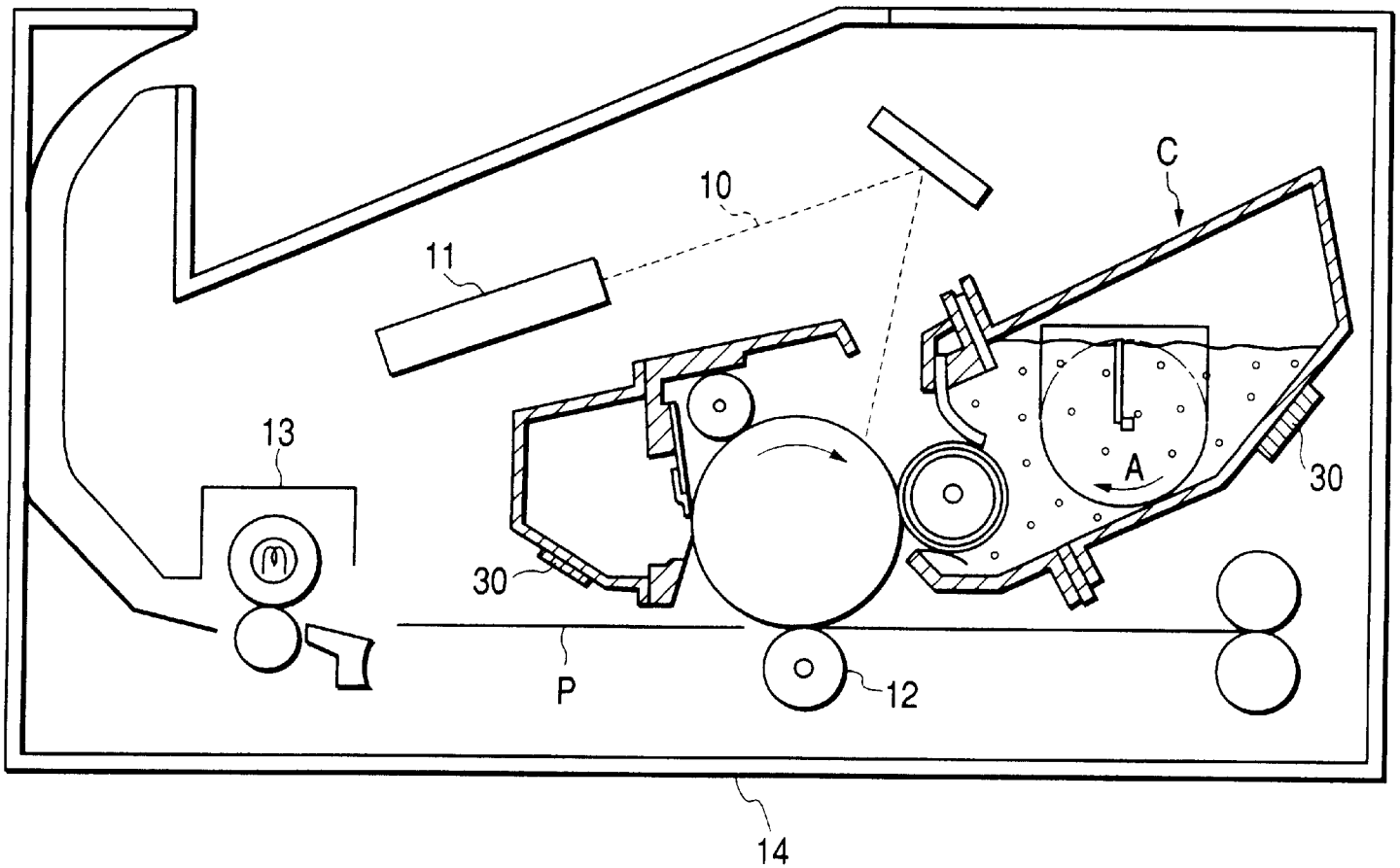
FIG. 1 schematically shows the construction of an embodiment of an electrophotographic image forming apparatus according to the present invention.
Figure 2:
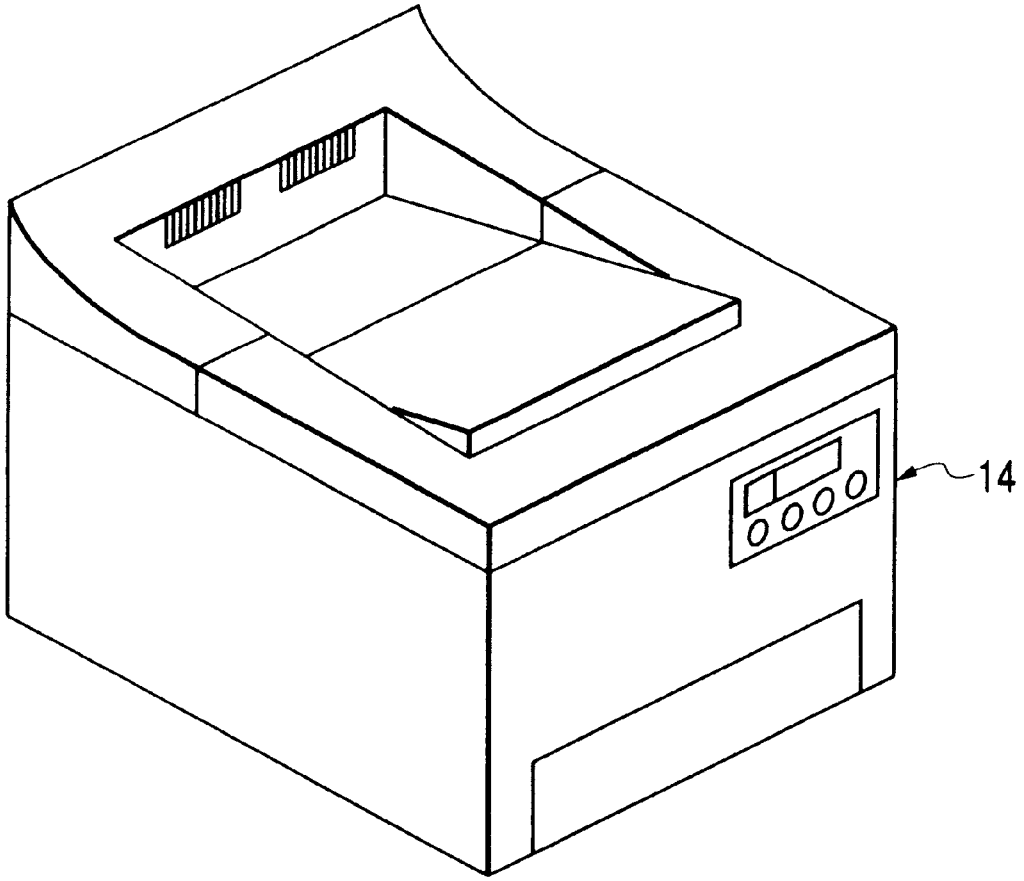
FIG. 2 is a pictorial perspective view of the electrophotographic image forming apparatus of FIG. 1.

In FIGS. 1 and 2, a laser printer which is an electrophotographic image forming apparatus according to the present embodiment is such that a process cartridge C is detachably mounted on the main body 14 of the apparatus through mounting means 30.

Figure 3:
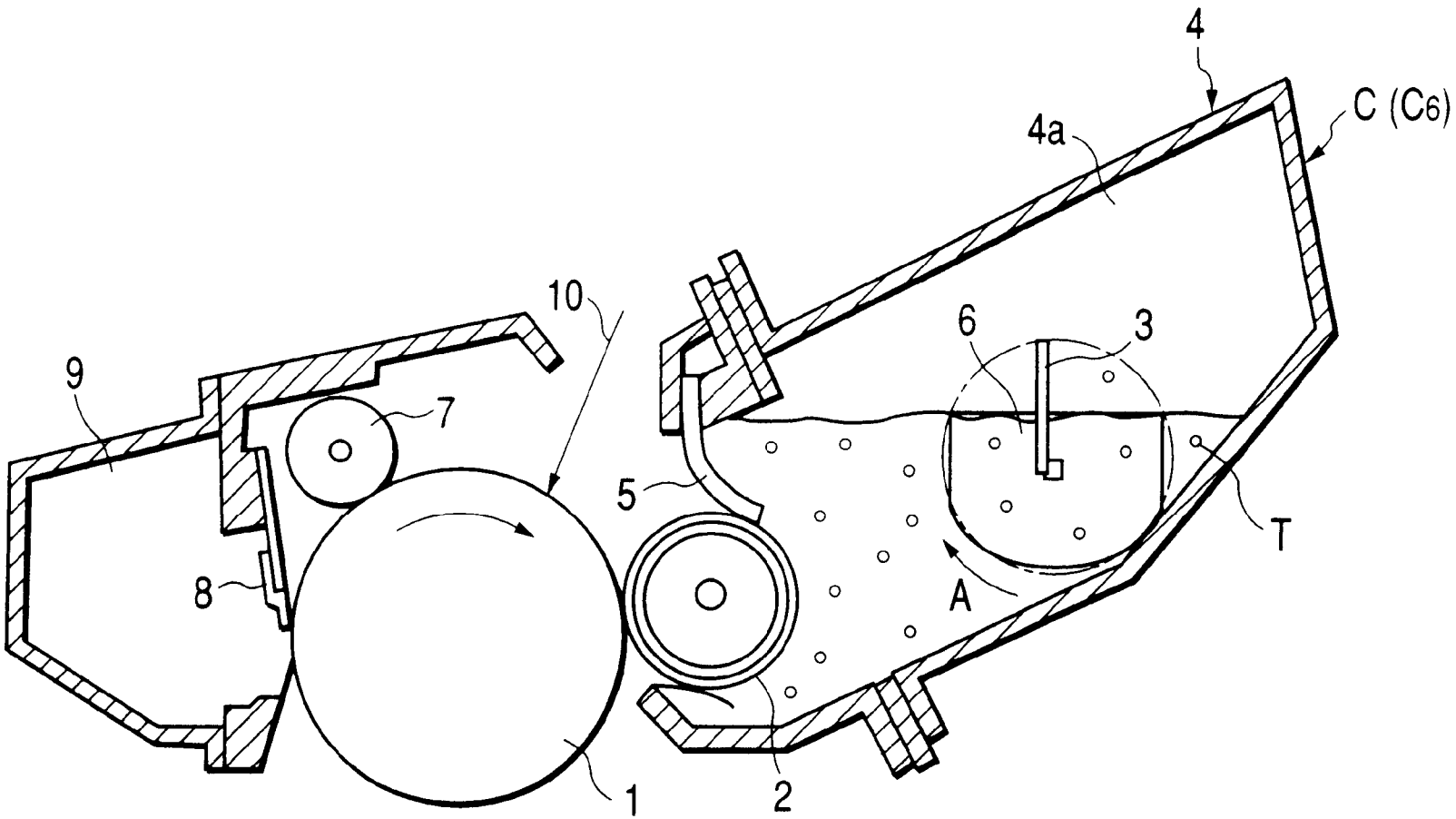
FIG. 3 shows the construction of a process cartridge mountable on the electrophotographic image forming apparatus of FIG. 1.

The process cartridge C in the present embodiment, as shown in FIG. 3, is integrally comprised of a photosensitive drum 1, which is an electrophotographic photosensitive member, charging means 7 for uniformly charging the photosensitive drum 1, a developing device 4, provided with a developing roller 2 as developing means disposed in opposed relationship with the photosensitive drum 1, and a toner container 4*a* as a developer container connected to the developing roller 2, cleaning means 8 for removing any residual toner on the photosensitive drum 1, and a waste toner container 9 for collecting therein the residual toner removed from the photosensitive drum 1 by the cleaning means 8.

Also, a laser scanner 11 for applying a laser beam 10 corresponding to image information is disposed as electrostatic latent image forming means above the process cartridge C, and transferring means 12 opposed to the photosensitive drum 1 is disposed below the process cartridge C.

In the above-described construction, the photosensitive drum 1 is uniformly charged by the charging means 7, and the surface thereof is scanned and exposed by the laser beam 10 applied from the laser scanner 11, whereby the electrostatic latent image of desired image information is formed. The electrostatic latent image has a toner T in the toner container 4*a* attached thereto by the action of the developing roller 2 and is visualized as a toner image. In the present embodiment, a magnetic monocomponent toner is used as the toner T.

The toner image on the photosensitive drum 1 is transferred to recording paper P, which is a recording medium, by the transferring means 12. The recording paper P has the toner image thereon fixed when it passes fixing means 13, and is discharged out of the main body of the apparatus.

Agitating means 3 rotated in the direction indicated by the arrow A in FIG. 3 is provided in the toner container 4*a*, and by this agitating means 3 being rotated, the toner T is loosened and is supplied to the developing roller 2.

Figure 4:
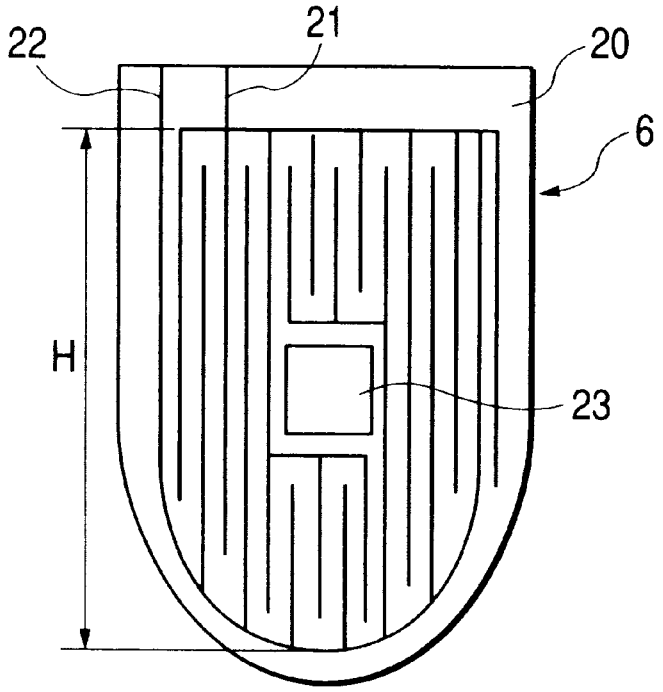
FIG. 4 shows a plane antenna for a 10K cartridge in a first embodiment.

Reference is now had to FIG. 4 to describe a plane antenna, which is planar developer amount measuring means in the present embodiment, for successively detecting the amount of toner in the toner container 4*a*.

The plane antenna 6 is formed with two conductor patterns, i.e., electrode patterns 21 and 22, on a generally used printed substrate 20 by etching or printing. Also, a protective film (not shown) is formed on the electrode patterns 21 and 22 to protect this circuit figure, and a through portion 23 for extending the rotary shaft (not shown) of the agitating means 3 therethrough is provided at the center of the plane antenna 6.

In the present embodiment, the interval between the electrode patterns 21 and 22 is as narrow as several tens of $\mu$m, and when an AC bias of 200 Vpp and 2000 Hz was applied between the electrode patterns 21 and 22, different capacitance values were measured, that is, 20 pF when the toner T is not in contact with the plane antenna 6, and 60 pF when the toner T is in contact with the whole surface of the plane antenna 6.

By disposing this plane antenna 6 on the inner side of the toner container 4*a* so as to be along a direction in which the toner T decreases, the area of contact between the toner T and the plane antenna 6 decreases with the decrease in the toner T in the toner container 4*a*, and a reduction in the capacitance between the electrode patterns 21 and 22 can be measured to thereby successively detect the amount of toner in the toner container 4*a*.

Even if as previously described, process cartridges (hereinafter referred to as the "cartridges") are of the same construction, the amount of toner in the 10K cartridge $C_{10}$ (FIG. 6) capable of forming images on 10,000 sheets in the standard pattern and the amount of toner in the 6K cartridge $C_6$ (FIG. 3) capable of forming images on 6,000 sheets differ from each other and therefore, as will be seen from the comparison between the two figures, the level of the toner T in the container at the start of use differs between the two cartridges.

Figure 6:
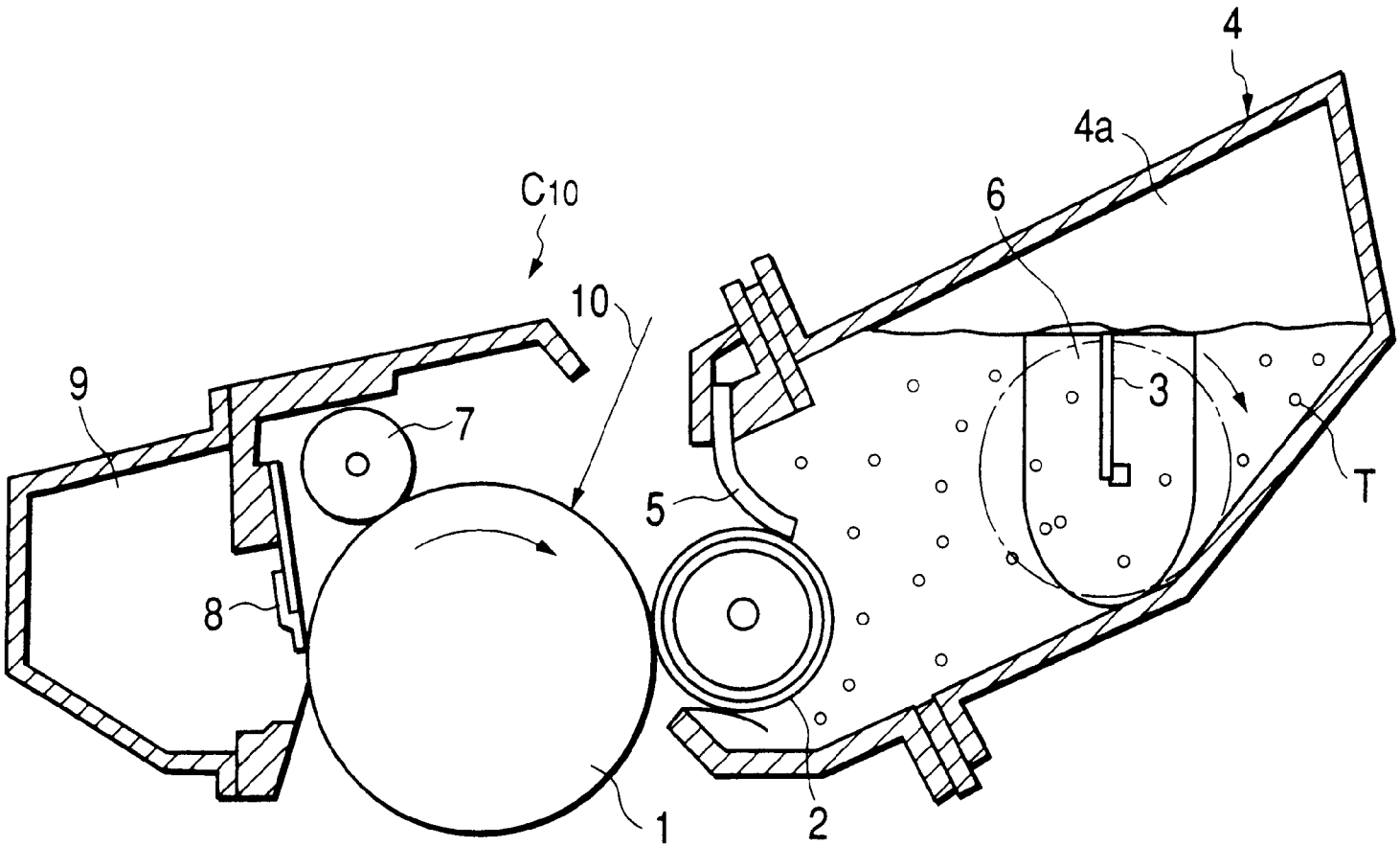
FIG. 6 shows the 10K plane antenna mounted on the 10K cartridge in the first embodiment.
Figure 7:
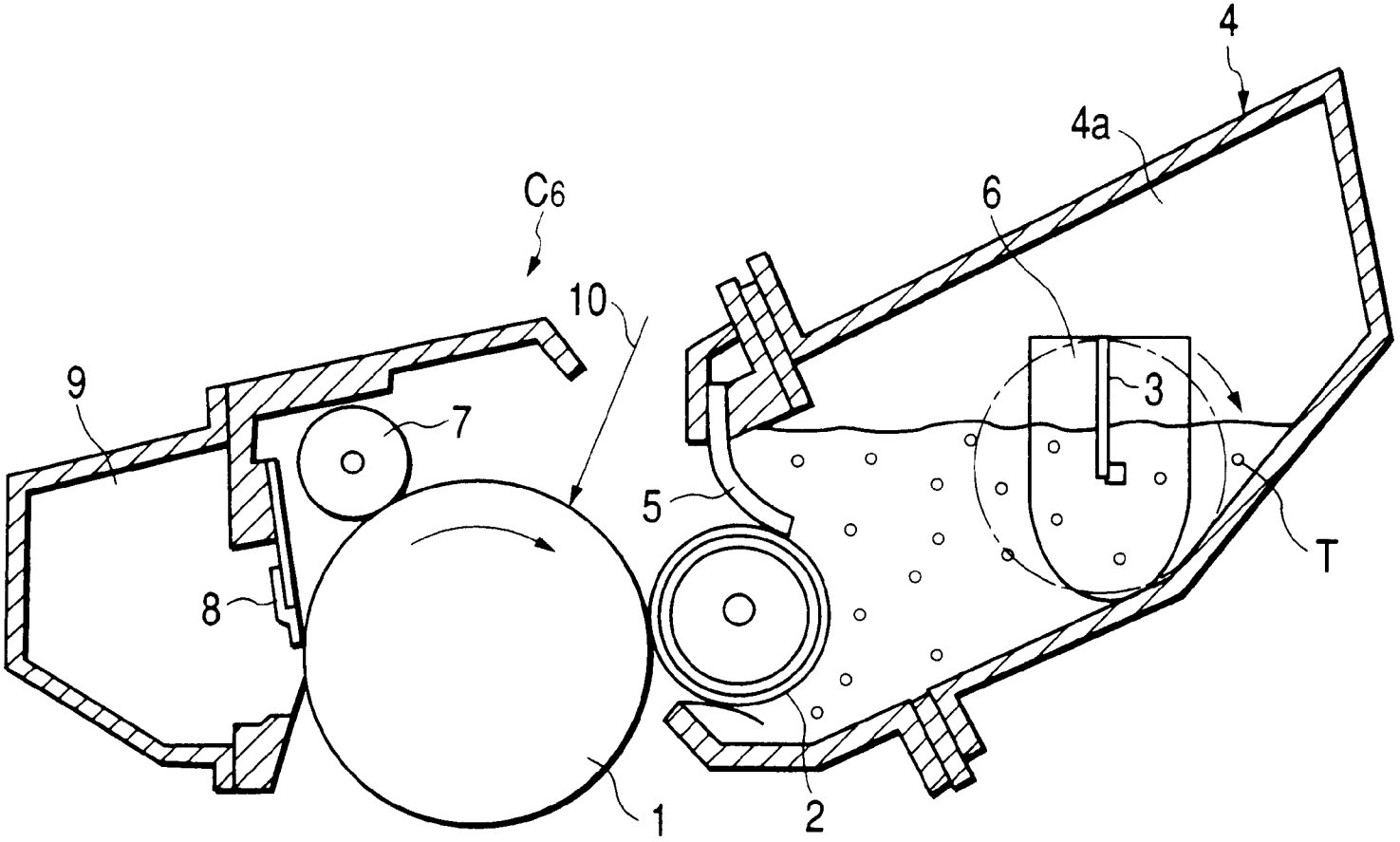
FIG. 7 shows the 10K plane antenna mounted on the 6K cartridge in the first embodiment.
Figure 9:
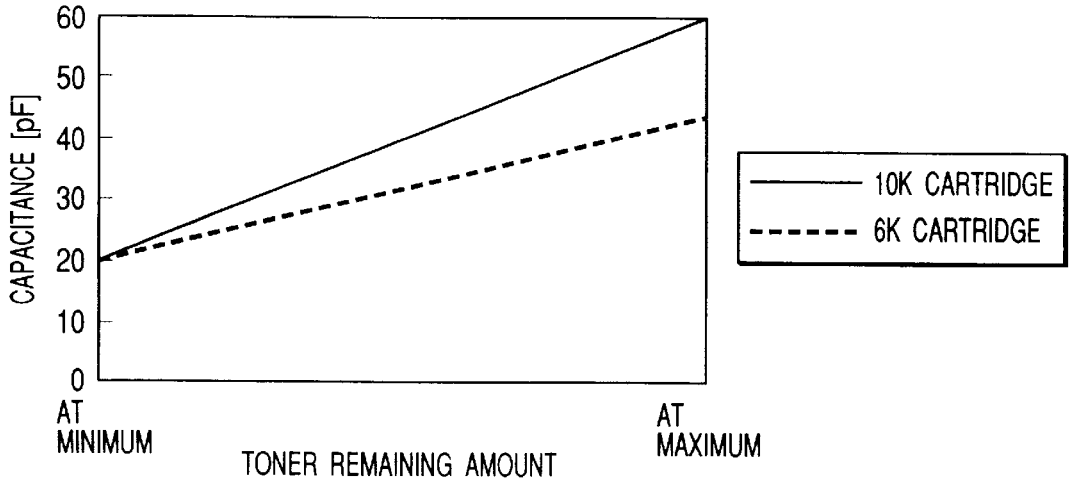
FIG. 9 is a graph showing the change of the capacitance from the filling time to the minimum when a cartridge having the 10K plane antenna incorporated therein is filled with toner amounts corresponding to 10K and 6K.
Figure 10:
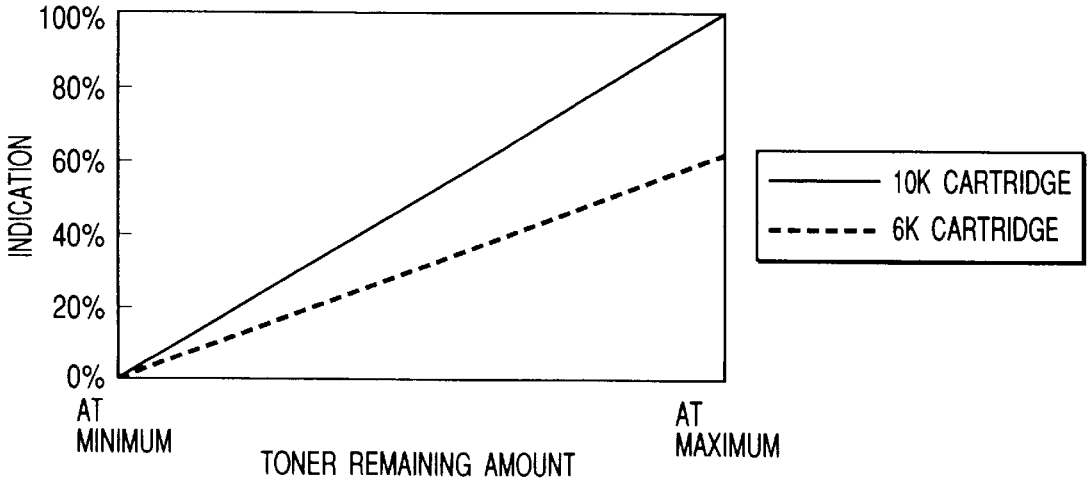
FIG. 10 is a graph showing the change of the "%" indication from the filling time to the minimum when the cartridge having the 10K plane antenna incorporated therein is filled with toners corresponding to 10K and 6K.

When in such a case, the amount of toner during the detection thereof is indicated as 00% at a percentage of that at a maximum, if as shown in FIG. 7, the same plane antenna 6 as that for the 10K cartridge $C_{10}$ is used for 6K cartridge $C_6$, the amount of toner will be indicated as small from the beginning as described with reference to FIGS. 9 and 6 because the area of contact with the plane antenna 6 differs between the two cartridges.

Figure 5:
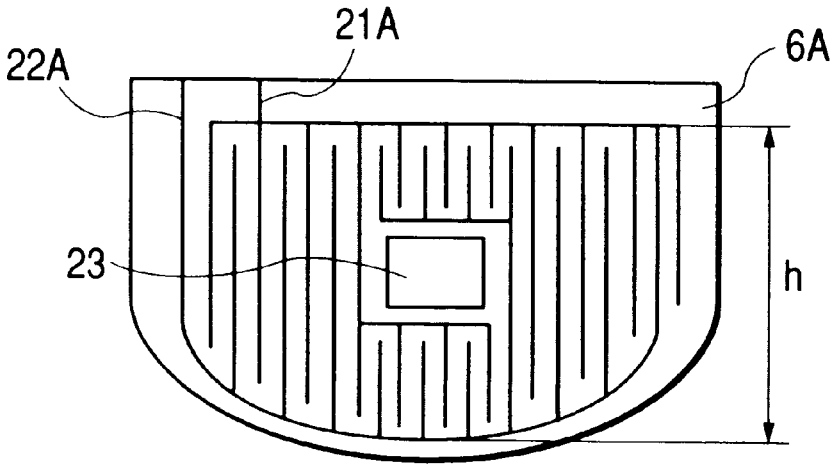
FIG. 5 shows a plane antenna for a 6K cartridge in the first embodiment.
Figure 11:
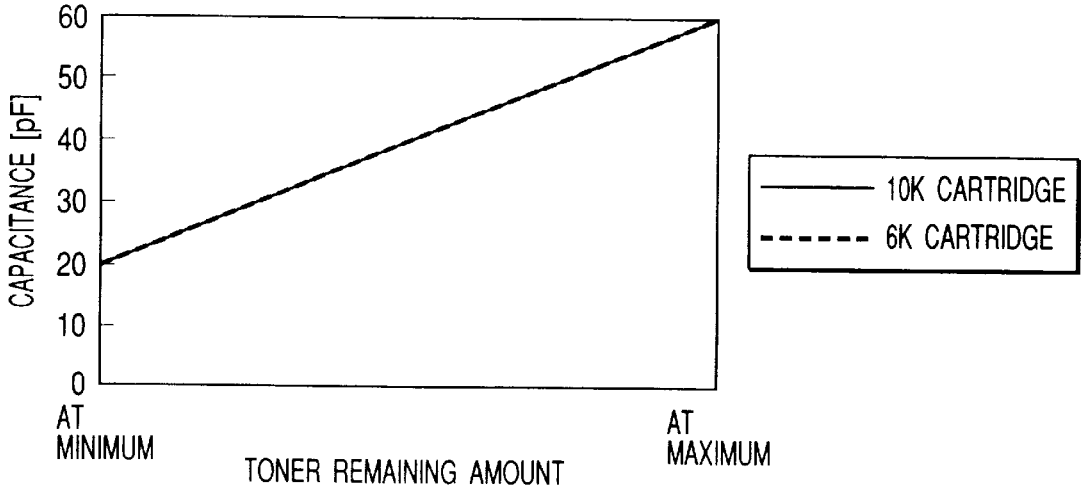
FIG. 11 is a graph showing the change of the capacitance from the maximum to the minimum when the cartridge having the 10K plane antenna incorporated therein is filled with a toner corresponding to 10K and when a cartridge having the 6K plane antenna incorporated therein is filled with a toner corresponding to 6K.
Figure 12:
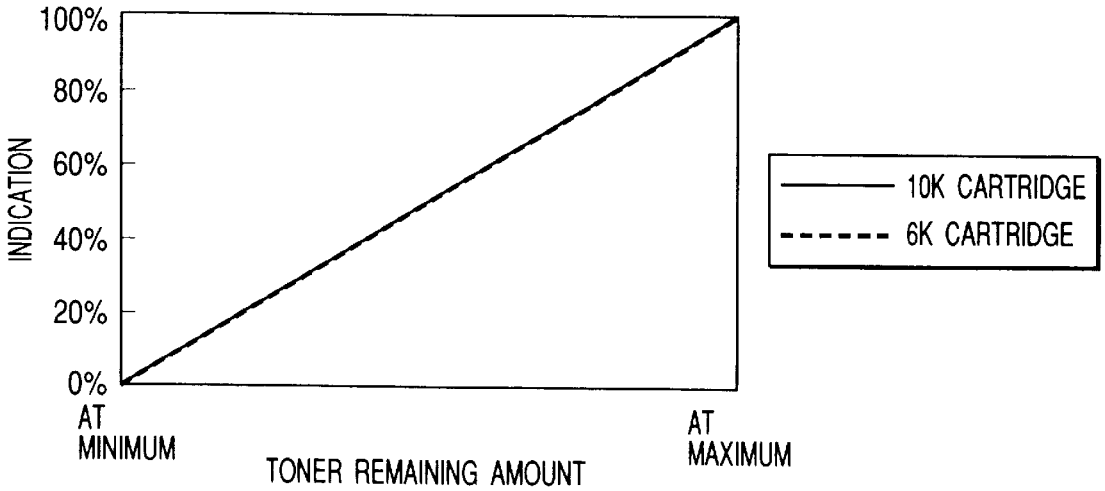
FIG. 12 is a graph showing the change of the "%" indication from the maximum to the minimum when the cartridge having the 10K plane antenna incorporated therein is filled with the toner corresponding to 10K and when the cartridge having the 6K plane antenna incorporated therein is filled with the toner corresponding to 6K.

So, in the present embodiment, as shown in FIGS. 11 and 12, in order that irrespective of the use of a 10K cartridge or a 6K cartridge, the capacitance of the plane antenna and the indication thereof may be indicated as 60 pF and 100% for the amount of toner at a maximum, and as 20 pF and 0% for the amount of toner at a minimum, the plane antenna 6A of the 6K cartridge $C_6$ shown in FIG. 5 has the same area as the electrode patterns 21 and 22 (see FIG. 4) of the plane antenna 6 of the 10K cartridge $C_{10}$ and is lower in the height (parallel to the direction of decrease in the toner) of electrode patterns 21A and 22A, that is, H>h, as shown in FIGS. 4 and 5.

As described above, according to the present embodiment, even if the constructions of the main body of the apparatus and the cartridge are not changed, the same indication becomes possible irrespective of whether a 10K cartridge or a 6K cartridge is used, as shown in FIG. 12. That is, the plane antenna can be used for a 6K cartridge with the area of the electrode patterns remaining the same.

Also, in the present embodiment, the area of the plane antenna is made constant irrespective of the toner capacity and therefore, the plane antenna becomes equal in the tolerance of manufacture and is the same in the width of the electrodes and the distance between the electrodes and as the result, it becomes possible to manufacture the plane antenna for a 6K cartridge while maintaining the accuracy of the plane antenna for a 10K cartridge. Therefore, the measurement accuracy of the toner capacity can be obtained at the same accuracy irrespective of the shape of the plane antenna.

Further, there is no necessity of providing means for discriminating the difference between the initial toner fill amounts of cartridges in the main body of the apparatus and therefore, the apparatus can be made low in cost.

Embodiment 2

A second embodiment of the present invention will now be described with reference to FIG. 8.

Figure 8:
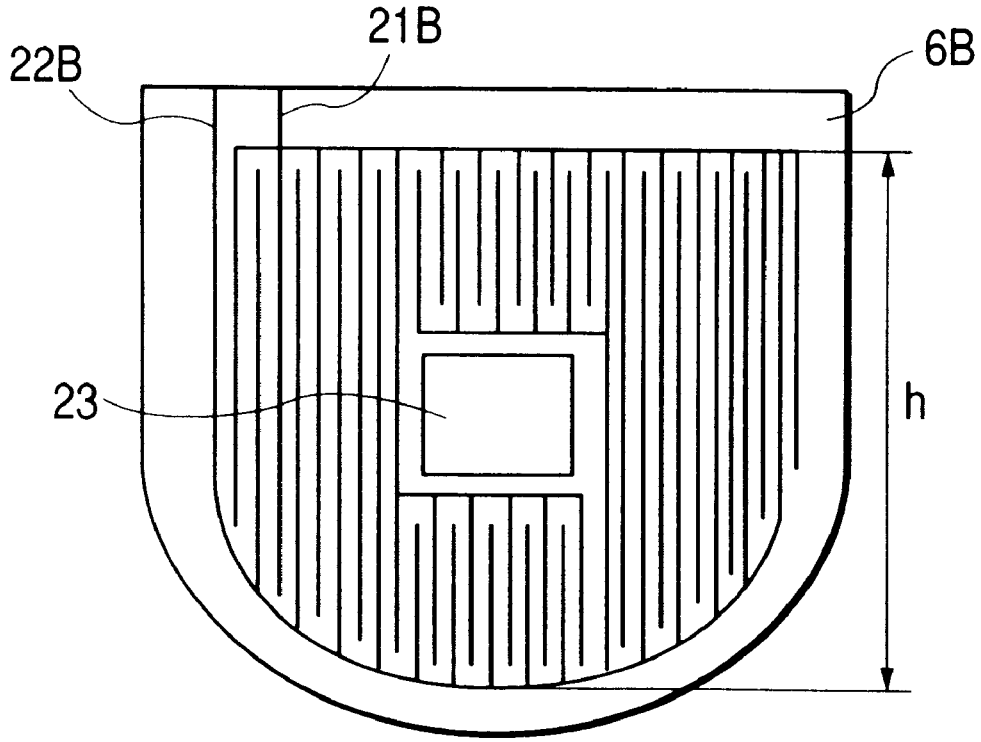
FIG. 8 shows a plane antenna in a second embodiment.

In the present embodiment, for example, in the case of 6K cartridge, as shown in FIG. 8, the height (parallel to the direction of decrease of the toner) h of the electrode patterns 21B and 22B of a plane antenna 6B is made low in accordance with the amount of toner during toner fill.

Also, the capacitance K can be expressed as $$K=\epsilon S/d$$

when the dielectric constant is defined as $\epsilon$ and the area of the electrode width between the patterns is defined as S and the distance between the electrodes of the patterns is defined as d, and therefore as compared with the plane antenna 6 for a 10K cartridge shown in FIG. 4, the area S of the line width of the electrode patterns 21B and 22B of the plane antenna 6B shown in FIG. 8 is rendered 6/10 that of the 10K cartridge and the distance d between the electrode patterns 21B and 22B is also rendered into 6/10 that of the 10K cartridge. As a result, again in the 6K cartridge, it becomes possible to obtain the same capacitance as that of the 10K cartridge as shown in FIG. 11, and even if the constructions of the main body of the apparatus and the cartridge are not changed, the amount of toner can be accurately indicated irrespective of whether a 10K cartridge or a 6K cartridge is used, as shown in FIG. 12, by only changing the construction of the plane antenna.

If the plane antenna for the 6K cartridge is manufactured as described above, the area of the antenna itself can be made smaller than that of the plane antenna for the 10K cartridge. That is, a plane antenna of an area conforming to the maximum amount of toner can be prepared. Thereby, in the present embodiment, the plane antenna can be made at a minimum cost.

Figure 13:
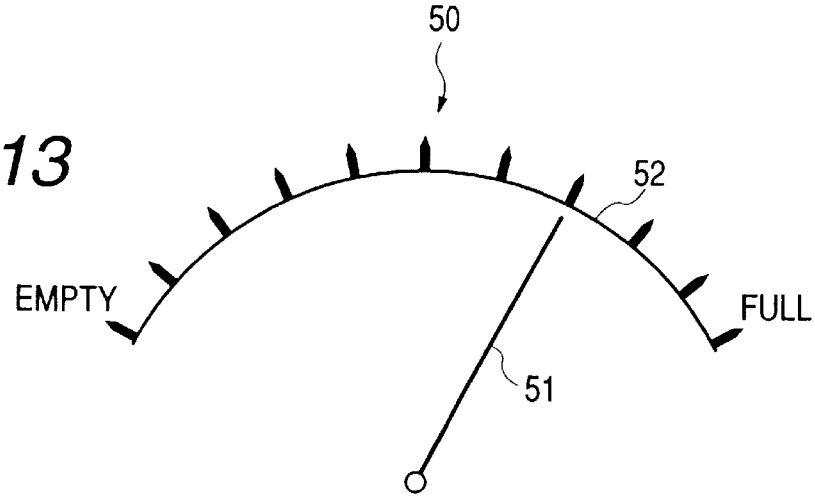
FIG. 13 shows an example of the toner amount indication.
Figure 14:
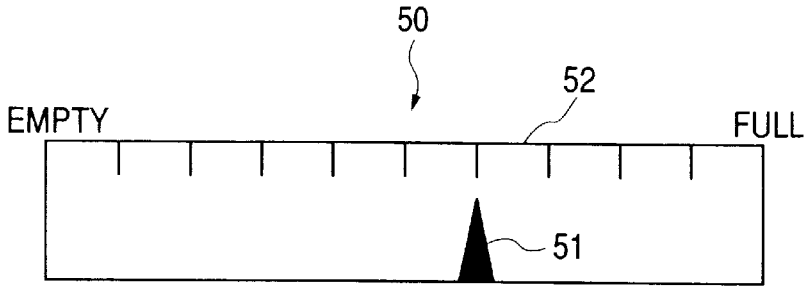
FIG. 14 shows another example of the toner amount indication.
Figure 15:
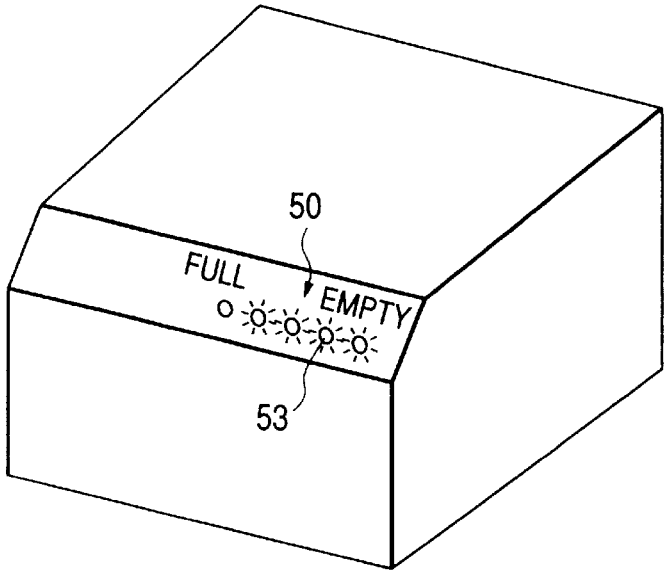
FIG. 15 shows still another example of the toner amount indication.

In the above-described embodiment, the amount of toner in the process cartridge is successively indicated as a percentage (%) to the amount of toner at the initial filling, and describing the indicating method therefor, the measurement information from the developer amount measuring means is indicated on an indicating device (developer amount indicating means) on a terminal screen in the user's personal computer. As shown in FIGS. 13 and 14, the amount of toner is reported to the user by which portion of a gauge 52 a pointer 51 moving in conformity with the amount of toner is pointing to in an indicating device 50. Also, as shown in FIG. 15, the indicating device 50 using an LED or the like may be directly provided on the main body of the electrophotographic image forming apparatus and the LED 53 may be turned on and off in conformity with the amount of toner.

As is apparent from the foregoing description, according to the process cartridge and the electrophotographic image forming apparatus of the present invention, the pair of electrodes of the planar developer amount measuring means are constructed in different patterns in conformity with the initial fill developer amount in the developer container, whereby even in the case of process cartridges identical in construction with each other and differing in the amount of developer at a maximum from each other, the amount of developer in the process cartridge can be successively indicated accurately.

While the invention has been described with reference to the structures disclosed herein, it is not confined to the details set forth and this application is intended to cover such modifications or changes as may come within the purposes of the improvements or the scope of the following claims.

What is claimed is:

1. A process cartridge detachably mountable on a main body of an electrophotographic image forming apparatus, said process cartridge comprising:

(a) an electrophotographic photosensitive member;

(b) developing means having a developer container containing therein a developer for developing an electrostatic latent image formed on said electrophotographic photosensitive member; and (c) planar developer amount measuring means having a pair of electrodes arranged at a predetermined interval in said developer container;

the pair of electrodes of said planar developer amount measuring means being constructed in different patterns in conformity with an initial fill developer amount in said developer container.

2. The process cartridge according to claim 1, wherein the heights of said pair of electrodes in a direction in which the developer decreases differ from each other, and areas thereof are constant.

3. The process cartridge according to claim 1, wherein the heights of and the interval between said pair of electrodes in a direction in which the developer decreases, and areas of the widths of the electrodes differ.

4. An electrophotographic image forming apparatus for forming an image on a recording medium on which a process cartridge is detachably mountable, comprising:

(a) mounting means for detachably mounting the process cartridge, said process cartridge having:

an electrophotographic photosensitive member;

developing means having a developer container containing therein a developer for developing an electrostatic latent image formed on said electrophotographic photosensitive member; and planar developer amount measuring means having a pair of electrodes arranged at a predetermined interval in said developer container; and (b) developer amount indicating means for indicating an amount of developer in said developer container as a ratio to an initial fill developer amount;

the pair of electrodes of said planar developer amount measuring means being constructed in different patterns in conformity with the initial fill developer amount in said developer container.

5. The electrophotographic image forming apparatus according to claim 4, wherein the heights of said pair of electrodes in a direction in which the developer decreases differ from each other, and areas thereof are constant.

6. The electrophotographic image forming apparatus according to claim 4, wherein the heights of and the interval between said pair of electrodes in a direction in which the developer decreases, and areas of the widths of the electrodes differ.

* * * * *